US009364703B1

(12) United States Patent
Kuka

(10) Patent No.: US 9,364,703 B1
(45) Date of Patent: Jun. 14, 2016

(54) MULTI-GRIP EXERCISE WEIGHT APPARATUS

(71) Applicant: Jared Kuka, Chattanooga, TN (US)

(72) Inventor: Jared Kuka, Chattanooga, TN (US)

(73) Assignee: Move Strong Functional Fitness Equipment, LLC, Chattanooga, TN (US)

( * ) Notice: Subject to any disclaimer, the term of this patent is extended or adjusted under 35 U.S.C. 154(b) by 0 days.

(21) Appl. No.: 14/536,838

(22) Filed: Nov. 10, 2014

Related U.S. Application Data

(63) Continuation of application No. 13/493,677, filed on Jun. 11, 2012.

(60) Provisional application No. 61/495,345, filed on Jun. 9, 2011.

(51) Int. Cl.

| | |
|---|---|
| ***A63B 21/00*** | (2006.01) |
| ***A63B 21/06*** | (2006.01) |
| ***A63B 21/072*** | (2006.01) |
| ***A63B 21/075*** | (2006.01) |

(52) U.S. Cl.
CPC ..... *A63B 21/0724* (2013.01); *A63B 21/0726* (2013.01); *A63B 21/0608* (2013.01); *A63B 21/072* (2013.01); *A63B 21/0722* (2015.10)

(58) Field of Classification Search
CPC ..... A63B 2021/0722; A63B 21/072; A63B 21/0726; A63B 21/0608; A63B 21/0722; A63B 21/0728; A63B 21/075; Y10T 74/20834; B62D 1/10; G05G 1/08; G05G 1/085; A61G 5/026
USPC ..... 482/92–93, 106–108; D21/680–682; 74/557; D23/253; 16/432
See application file for complete search history.

(56) References Cited

U.S. PATENT DOCUMENTS

| | | | |
|---|---|---|---|
| 1,138,196 | A | 5/1915 | Diehl |
| 4,029,312 | A | 6/1977 | Wright |
| 4,345,756 | A | 8/1982 | Hoagland |
| 4,623,142 | A | 11/1986 | MacKechnie |
| 5,024,434 | A | 6/1991 | Smith |
| 5,137,502 | A | 8/1992 | Anastasi |
| 5,334,113 | A | 8/1994 | Roepke |

(Continued)

FOREIGN PATENT DOCUMENTS

| | | | |
|---|---|---|---|
| DE | 9415329 | U1 | 12/1994 |
| EP | 2021083 | B1 | 6/2013 |
| WO | 2013101247 | A1 | 7/2013 |

OTHER PUBLICATIONS

FIFE U.S. Appl. No. 60/857,717, filed Nov. 7, 2006.

(Continued)

*Primary Examiner* — Oren Ginsberg
*Assistant Examiner* — Joshua Lee
(74) *Attorney, Agent, or Firm* — Ryan D. Levy; Patterson Intellectual Property Law, P.C.

(57) ABSTRACT

A multi-grip exercise weight apparatus includes a weight plate pivotally attached to a bar handle such that the weight plate is pivotable in both angular directions. A grip ring is disposed around the perimeter of the weight plate. A plurality of support spokes extend from a central hub on the weight plate radially outwardly to the grip ring. A plurality of different grip regions are defined on the grip ring between adjacent support spokes. An end handle may be attached to the weight plate to provide a looped kettlebell-type grip.

20 Claims, 10 Drawing Sheets

(56) References Cited

U.S. PATENT DOCUMENTS

| | | | |
|---|---|---|---|
| 5,709,634 | A | 1/1998 | Pointer |
| D406,183 | S | 2/1999 | Zovich |
| D474,517 | S | 5/2003 | Harms |
| 6,702,723 | B2 | 3/2004 | Landfair |
| 6,736,765 | B2 | 5/2004 | Wallace et al. |
| 6,746,380 | B2 | 6/2004 | Lien et al. |
| D502,514 | S | 3/2005 | Buchanan et al. |
| 7,014,598 | B2 | 3/2006 | Fenelon et al. |
| 7,025,713 | B2 | 4/2006 | Dalebout et al. |
| 7,094,182 | B1 | 8/2006 | Holten |
| 7,491,156 | B1 | 2/2009 | GaoYong |
| 7,704,196 | B2 | 4/2010 | Lien et al. |
| 7,780,582 | B2 | 8/2010 | Anderson |
| 7,883,452 | B1 | 2/2011 | Chen |
| 7,942,792 | B1 | 5/2011 | Wyman et al. |
| 8,012,069 | B2 | 9/2011 | Towley, III et al. |
| D684,224 | S | 6/2013 | Davies |
| D688,759 | S | 8/2013 | Davies |
| 8,591,387 | B2 | 11/2013 | Fife |
| 2004/0063553 | A1 | 4/2004 | Viscount |
| 2004/0077466 | A1 | 4/2004 | Wallace et al. |
| 2007/0135271 | A1 | 6/2007 | Lien et al. |
| 2008/0108483 | A1 | 5/2008 | Fife |
| 2011/0111929 | A1 | 5/2011 | Allison et al. |
| 2012/0172182 | A1 | 7/2012 | Leier et al. |

OTHER PUBLICATIONS

G300 Thrust Washer / Flange Bearings manufactured by Iguss Inc., East Providence, Rhode Island.

MULTI-GRIP EXERCISE WEIGHT APPARATUS

This application is a continuation application claiming priority to U.S. patent application Ser. No. 13/493,677, filed Jun. 11, 2012, and entitled "Multi-Grip Exercise Weight Apparatus."

This is a Non-Provisional Patent Application filed by applicant Move Strong Functional Fitness Equipment, LLC for the invention by Jared Kuka, a citizen of the United States, residing at 5751 Uptain road, Suite 210, Chattanooga, Tenn. 37411, of an "Multi-Grip Exercise Weight Apparatus."

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

All patents and publications described or discussed herein are hereby incorporated by reference in their entirety.

BACKGROUND

The present invention relates generally to weight-lifting exercise equipment and more particularly to hand-held dumbbell and barbell devices.

Conventional dumbbell and barbell devices for weightlifting exercises typically include a bar handle that is gripped by one or both of a user's hands. One or more weight plates may be secured onto each end of the bar handle for adding resistance weight. A user typically repeatedly lifts the weighted bar handle with attached weights for exercise training. The weights may be detached and different interchangeable weights may be secured to the bar handle for different resistance levels.

One problem associated with conventional dumbbell and barbell weight systems includes the limited nature of exercises that may be performed using a single device. Because such conventional devices typically only include a central grip portion located on the bar handle between the weight plates, a user can typically only perform lifting exercises that keep the bar handle in a substantially level position. This limited flexibility of conventional weight devices can be disadvantageous in many applications. For example, users who desire to perform other types of lifting motions that require different grip locations may be forced to acquire different weights to accommodate different grip locations.

Alternatively, in some situations, users may attempt to use conventional dumbbell or barbell weight devices to perform types of lifting exercises that require gripping the weight plates directly. However, conventional devices are not designed for by directly gripping the end weight plates. Such misuse of conventional devices may result in damage to the equipment or serious injury to the user, including wrist, elbow or shoulder injuries.

An additional problem associated with conventional weight devices includes moment of inertia, or rotational or torsional inertia, created during lifting exercises. Because conventional weight lifting devices, and particularly conventional dumbbell devices, include weight plates that are fixed to the bar handle or rigidly secured to the bar handle, a user may experience a large moment of inertia during lifting exercises. This may cause injury to the user's hand, wrist and arm when such devices are lifted in either a horizontal or a vertical configuration.

Additionally, in many applications, users may desire to perform lifting exercises that require using a kettlebell grip. Such a grip is not possible using conventional dumbbell and barbell devices.

What is needed then are improvements in exercise weight devices and associated methods for allowing users to engage the devices in multiple grip locations as required for different types of lifting exercises and also for reducing the moment of inertia on the device during the lifting exercise.

BRIEF SUMMARY

The present disclosure provides a multi-grip exercise weight apparatus that allows numerous grip locations for a user to position one or both hands during a lifting exercise. By providing multiple grip locations, a variety of exercises can be performed using only one device.

A first embodiment of the present invention provides a multi-grip exercise weight apparatus including a bar handle having a first bar end and a second bar end. A first weight plate is attached to the first bar end. The first weight plate includes a hub pivotally attached to the bar handle, and the hub has a first radius. A first grip ring is also disposed on the first weight plate. The first grip ring includes a second radius larger than the first radius. A first support spoke extends between the hub and the first grip ring. A second support spoke also extending between the hub and the first grip ring. A first arcuate grip region is defined on the first grip ring. The first arcuate grip region extends between the first and second support spokes. A first hand clearance opening is defined radially between the first arcuate grip region and the hub and angularly between the first and second support spokes. The first hand clearance region is shaped to accommodate a portion of a user's hand.

Yet another embodiment of the present disclosure provides a weight plate apparatus for attachment to a bar handle on an exercise weight. The weight plate apparatus includes a hub and a plurality of support spokes extending radially from the hub. A grip ring is disposed on the support spokes. The grip ring includes a plurality of grip regions, each grip region located on the grip ring between adjacent support spokes. The weight plate apparatus also includes a plurality of hand clearance openings defined angularly between adjacent ones of the plurality of support spokes and located radially between the hub and the grip ring.

A further embodiment of the present disclosure provides a multi-grip exercise weight apparatus including a bar handle having a first bar end and a second bar end. A first weight plate is attached to the first bar end, the first weight plate being freely pivotally attached to the bar handle in both angular directions. The first weight plate defines a weight plate axis of rotation oriented substantially parallel to the longitudinal axis of the bar handle. A first grip ring is disposed on the first weight plate. A hub is disposed on the first weight plate. A plurality of support spokes extend radially between the hub and the first grip ring. The first grip ring defines a plurality of grip regions separated by adjacent support spokes. A first end handle extends from the first weight plate in an axial direction away from the bar handle. The first end handle includes an end handle grip oriented substantially transverse to the weight plate axis of rotation. A second weight plate is attached to the second bar end.

An additional object of the present disclosure is to provide a dumbbell apparatus that can be used interchangeably with a dumbbell grip and with a kettlebell grip.

A further object of the present disclosure is to provide a dumbbell apparatus that can be gripped on the weight plate as opposed to the central bar handle.

Another object of the present disclosure is to provide a dumbbell apparatus that includes a freely rotatable weight plate for reducing moment of inertia during lifting exercises.

Yet another object of the present disclosure is to provide a dumbbell apparatus with removable weight plates.

A further object of the present disclosure is to provide a weight plate apparatus that can be independently used in a variety of grip configurations for performing lifting exercises.

Numerous other objects, features, and advantages of the present disclosure will be readily apparent to those skilled in the art, upon a reading of the following disclosure, when taken in conjunction with the accompanying drawings.

DETAILED DESCRIPTION

Figure 1:
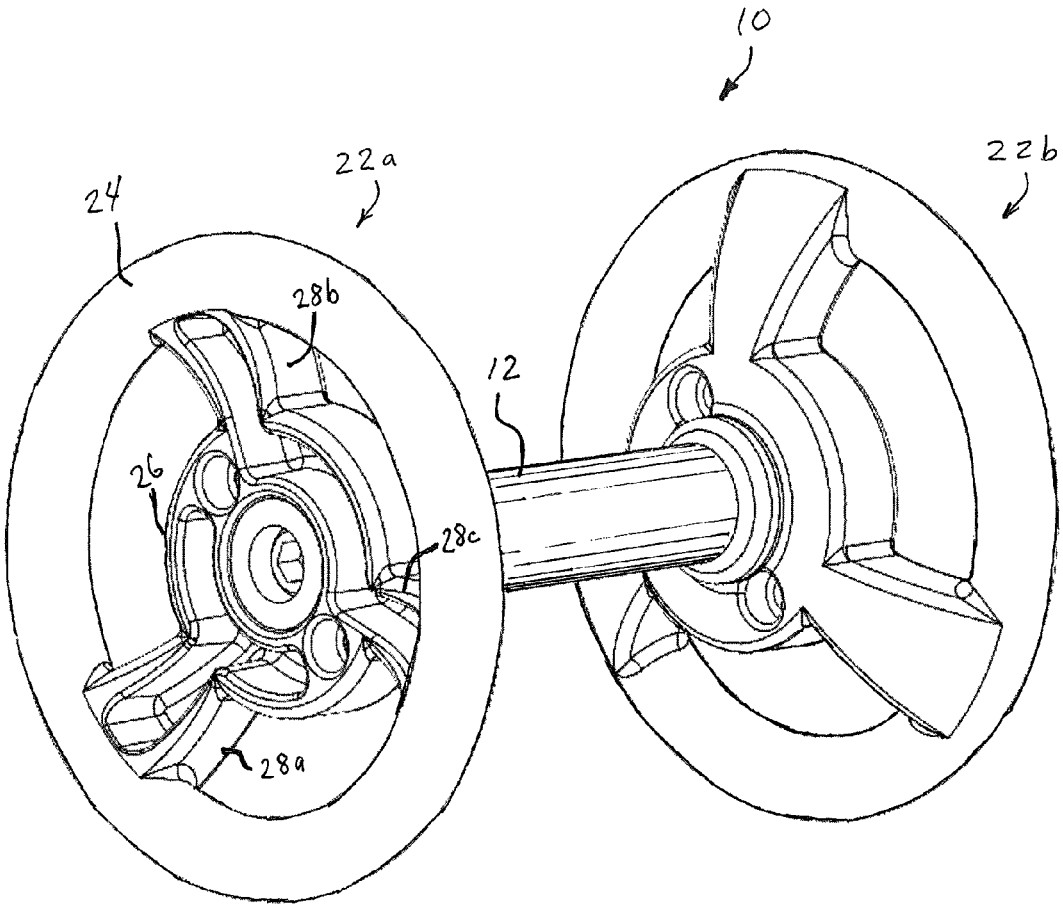
FIG. 1 illustrates a perspective view of an embodiment of a multi-grip exercise weight apparatus in accordance with the present disclosure.

Referring now to the drawings, FIG. 1 illustrates an exemplary embodiment of a multi-grip exercise weight apparatus 10 in accordance with the present disclosure. Weight 10 includes a bar handle 12 having a first bar end 16*a* and a second bar end 16*b*. In some embodiments, bar handle 12 includes a steel rod having an outer diameter of between about one and about two inches. Bar handle 12 is generally adapted to be manually gripped by a user for lifting weight 10 during weight lifting exercise.

Figure 2:
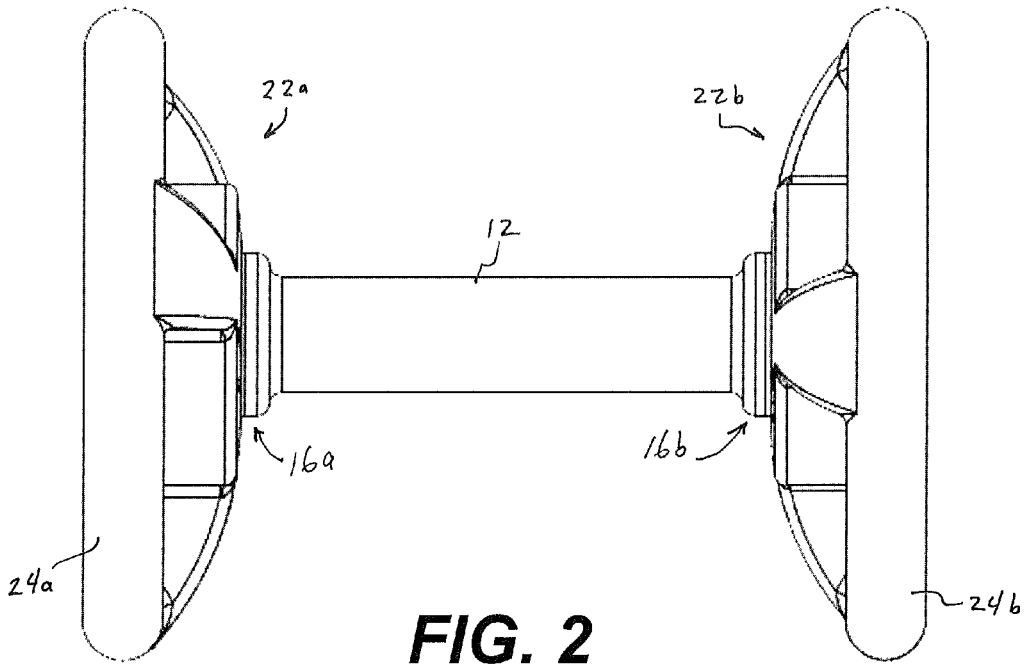
FIG. 2 illustrates a front elevation view of the embodiment of a multi-grip exercise weight apparatus of FIG. 1.

As seen in FIG. 1 and FIG. 2, a first weight plate 22*a* is attached to first bar end 16*a*, and a second weight plate 22*b*, is attached to second bar end 16*b*. First and second weight plates 22*a*, 22*b* may be substantially identical in some embodiments and may correspond to a standardized mass for weight lifting exercises. In some embodiments, first and second weight plates 22*a*, 22*b* may be part of a kit of interchangeable weight plates all having different standardized masses.

First weight plate 22*a* includes a hub 26 configured for attachment to bar handle 12. In some embodiments, hub 26 is pivotally attached to bar handle 12 such that hub 26 is freely rotatable in both angular directions relative to bar handle 12. Hub 26 includes a circular body having a central hub bore 54, seen in FIG. 8. Hub bore 54 includes an axial clearance opening used for attaching first weight plate 22*a* to bar handle 12 using a hub fastener 62, as seen in an exemplary embodiment in FIG. 4.

Figure 4:
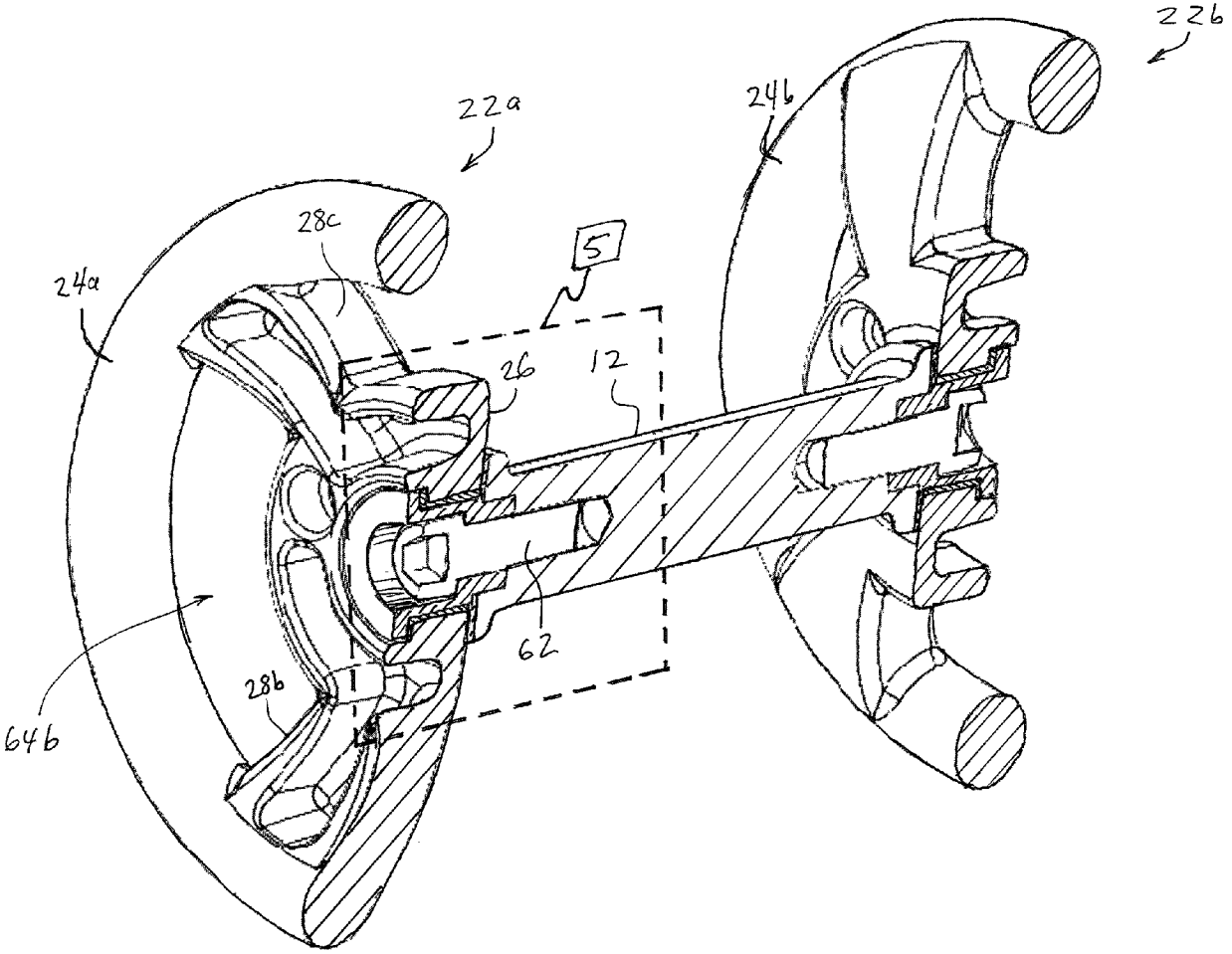
FIG. 4 illustrates a partial cross-sectional perspective view of the embodiment of a multi-grip exercise weight apparatus of FIG. 1.

A first grip ring 24 is disposed on first weight plate 22*a*. Hub 26 generally includes a first radius, and first grip ring 24 includes a second radius larger than the first radius. First grip ring 24 extends circumferentially around first weight plate 22*a* in some embodiments. In additional embodiments, first grip ring 24 extends only partially around the perimeter of first weight 22*a*. First grip ring 24 includes a round cross-sectional profile as seen in FIG. 4 to provide a gripping structure for allowing a user an alternative location to manually grasp weight 10.

Figure 3:
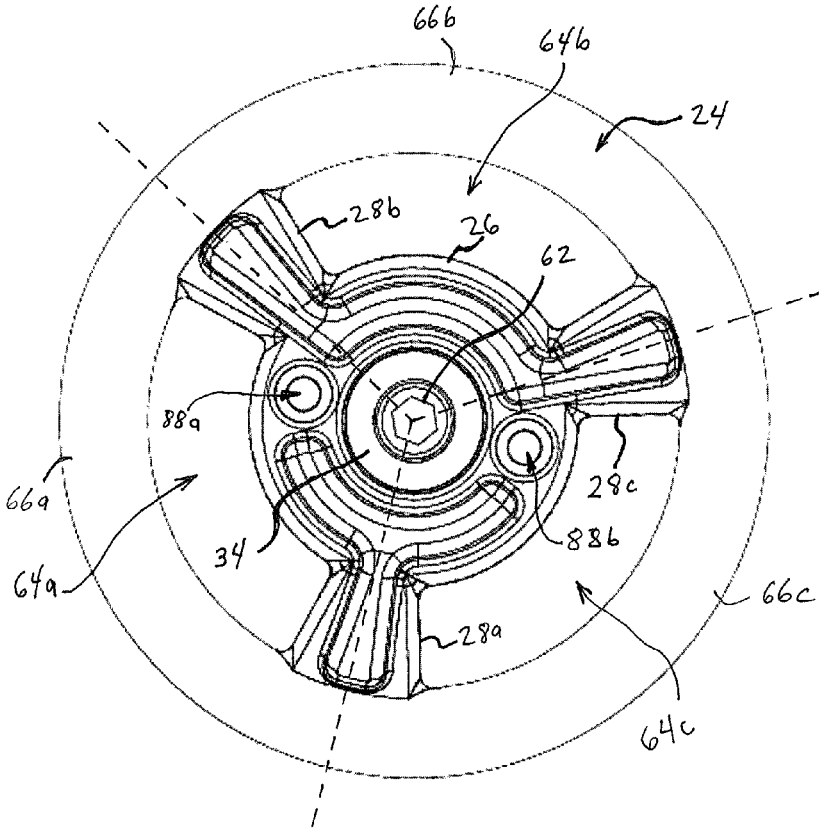
FIG. 3 illustrates an end view of the embodiment of a multi-grip exercise weight apparatus of FIG. 1.

As seen in FIG. 3, first grip ring 24 may be divided into a plurality of different grip regions 66*a*, 66*b*, 66*c*. Each grip region 66*a*, 66*b*, 66*c* provides a location where a user can position one or both hands for lifting and performing exercises with weight 10. A plurality of support spokes 28 extend between hub 26 and grip ring 24. In some embodiments, as seen in FIG. 1, three support spokes 28*a*, 28*b*, 28*c* extend between hub 26 and grip ring 24. However, in other embodiments, only one support spoke, only two support spokes, only three support spokes, or more than three support spokes may be present. In some embodiments, hub 26 and each support spoke 28 are integrally formed in a one-piece construction. For example, in some embodiments, hub 26 and each support spoke 28 are formed of an injection molded or machined non-metal material such as a polymer or a plastic material. In other embodiments, hub 26 and each support spoke 28 are integrally formed in a one-piece construction comprising a metal material. In various other embodiments, hub 26, support spokes 28 and grip ring 24 are all integrally formed in a one-piece construction.

A first arcuate grip region 66*a* is defined on grip ring 24 between first and second support spokes 28*a*, 28*b*. First arcuate grip region 66*a* includes only a portion of grip ring 24 and is generally located between adjacent support spokes of the plurality of support spokes. For example, as seen in FIG. 3, first arcuate grip region 66*a* is defined as the portion of grip ring 24 between first support spoke 28*a* and second support spoke 28*b*. Additionally, a second arcuate grip region 66*b* is defined as the portion of grip ring 24 adjacent first grip region 66*a*. In some embodiments, a third support spoke 28*c* extends radially between hub 26 and grip ring 24, and second arcuate grip region 66*b* is defined as the portion of grip ring 24 extending between second and third support spokes 28*b*, 28*c*. Also seen in FIG. 3, a third arcuate grip region 66*c* is defined as the portion of grip ring 24 extending between third support spoke 28*c* and first support spoke 28*a*.

Each grip region 66*a*, 66*b*, 66*c* generally provides a location where a user may position one or more hands for lifting weight 10. For example, during a lifting exercise, a user may grasp and pick up weight 10 by gripping first grip region 66*a* instead of bar handle 12. Additionally, a user may position a left hand on first grip region 66*a* and a right hand on bar handle 12. Alternatively, a user may position a left hand on second grip region 66*b* and a right hand on first grip region 66*a*. This type alternative grip configuration allows users to use the weight 10 to perform additional exercises that are not possible by grasping the bar handle 12 alone.

Each grip region 66*a*, 66*b*, 66*c* may include a non-arcuate, linear or polygonal shape in some alternative embodiments.

Referring further to FIG. 3, in some embodiments, a plurality of hand clearance openings 64 are defined radially between grip ring 24 and hub 26 and angularly between adjacent support spokes 28. A first hand clearance opening 64*a* is defined radially between first grip region 66*a* on grip ring 24 and hub 26, and angularly between first and second support spokes 28*a*, 28*b*. First hand clearance opening 64 provides a clearance space for a users hand or fingers to extend when the user is gripping grip ring 24 along first grip region 66*a*. A user may grasp grip ring 24 from the outside with the users palm directed radially inwardly toward hub 26. Alternatively, a user may grasp grip ring 24 from the inside with the user's palm directed radially outwardly away from hub 26. In either gripping configuration, each hand clearance opening 64 provides a space for the user's hand or fingers to fit without interfering with the hub 26. Additionally, a second hand clearance opening 64*b* is defined radially between second grip region 66*b* on grip ring 24 and hub 26. Second hand clearance opening 64*b* is defined angularly between second support spoke 28*b* and first support spoke 28*a*, in some embodiments, or third support spoke 28*c* in other embodiments that include a third support spoke 28*c*. In embodiments that include a third support spoke 28*c*, a third hand clearance opening 64*c* is defined radially between hub 26 and third grip region 66*c*, and angularly between third and first support spokes 28*c*, 28*a*. Generally, each one of the plurality of hand clearance openings 64 is defined angularly between adjacent ones of the plurality of support spokes 28, and each one of the plurality of hand clearance openings 64 is located radially between the hub and the grip ring 24.

In some embodiments, each weight plate 22 is freely pivotable relative to bar handle 12 in both angular directions. As such, a moment of inertia, or torsional inertia, that may be created in one or both weight plates 22 during a lifting exercise is not fully transferred to bar handle 12, and correspondingly to the user's hand, wrist or arm. Thus, a user of some embodiments of the devices of the present disclosure may experience reduced fatigue and injury associated with reduction in moment of inertia.

Weight plate 22 in some embodiments provides a standalone invention that can be used independently of handle bar 12 for performing lifting exercises. Grip ring 24 on weight plate 22 provides numerous gripping locations for grasping weight plate 22. In many applications, it is desirable to perform lifting exercises using only a weight plate. The various embodiments of weight plate 22 described herein offer improvements over conventional weight plates in such applications, including the ability to grip the weight plate 22 by grip ring 24.

Figure 5:
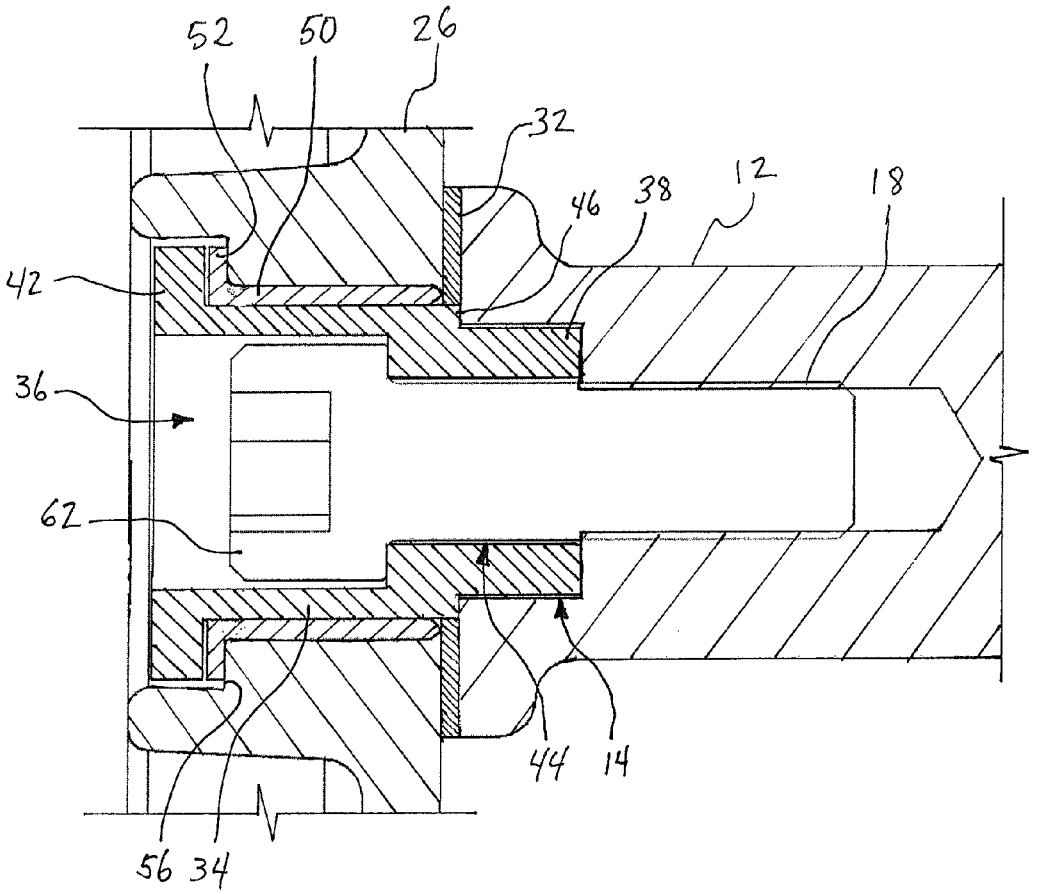
FIG. 5 illustrates a detail cross-sectional view of Section 5 from FIG. 4.
Figure 6:
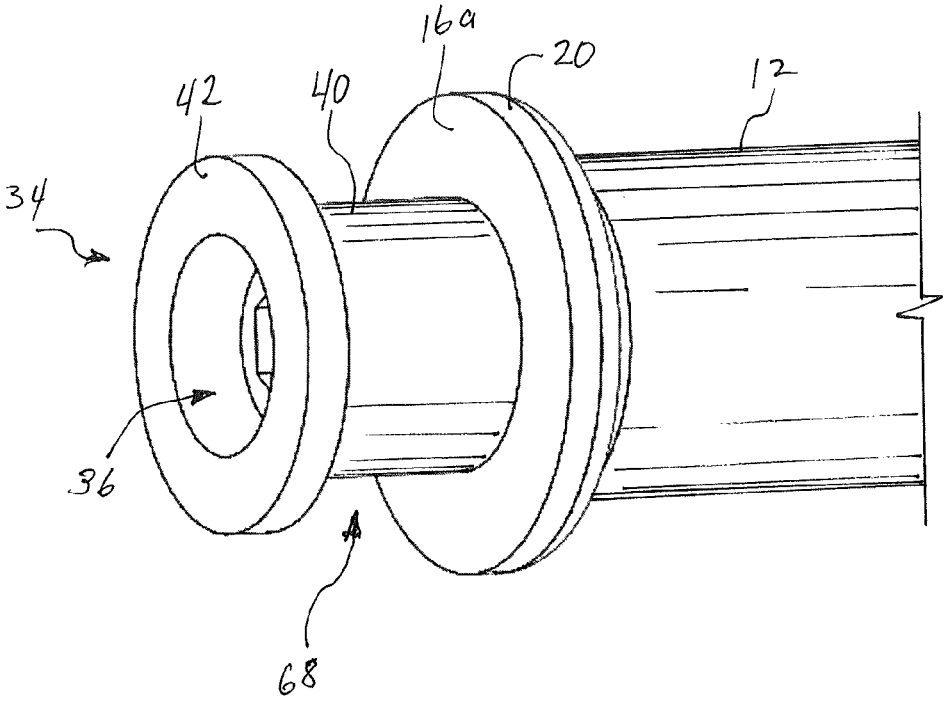
FIG. 6 illustrates a detail perspective view of an embodiment of a bar handle fitted with a retainer cap for providing a hub axle.
Figure 7:
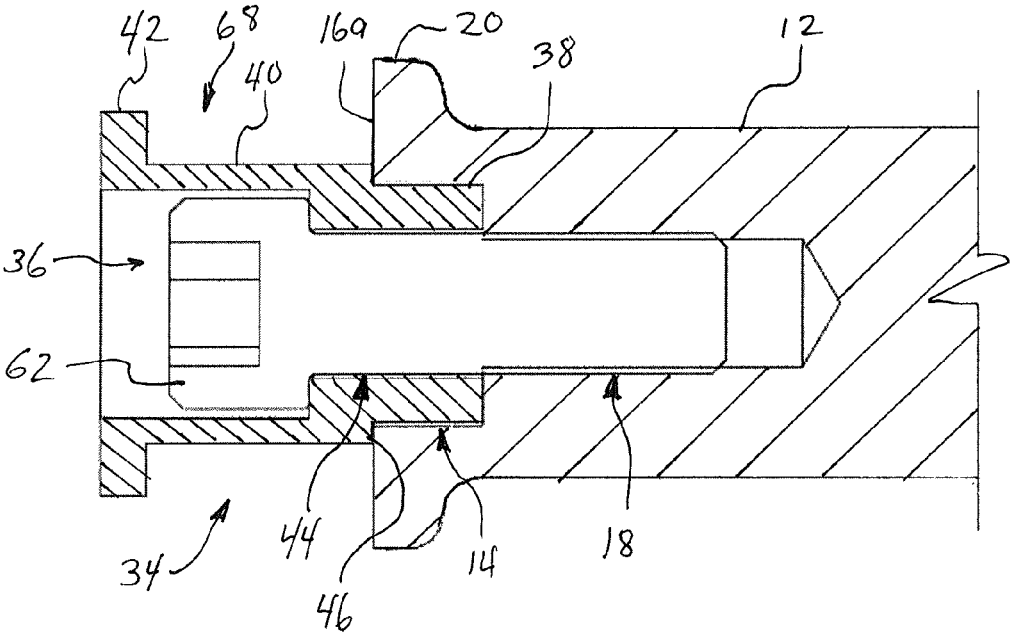
FIG. 7 illustrates a partial cross-sectional view of the embodiment of a bar handle fitted with a retainer cap of FIG. 6.

Various attachment configurations known in the art may be used to secure each weight plate 22 to bar handle 12 in a pivotable connection. However, the present disclosure offers additional inventive pivotable attachment configurations. For example, as seen in FIG. 6 and FIG. 7, in some embodiments, a retainer cap 34 may be attached to each end of bar handle 12. In this embodiment, retainer cap 34 is attached to first bar end 16*a* via bar socket 14. Bar socket 14 includes an axial hole defined in the end of bar handle 12. Retainer cap 34 includes a cap insert section 36 shaped to fit in bar socket 14. A cap shoulder 46 on retainer cap 40 defines the location where cap insert section 36 begins to axially protrude from cap hub section 40. Cap hub section 40 defines the location where hub 26 is supported on retainer cap 34. Cap hub section 40 extends axially from first bar end 16*a* when retainer cap 34 is installed on bar handle 12. Cap hub section 40 generally provides an axle for mounting hub 26 on weight plate 22, as seen in FIG. 5. Also seen in FIG. 6 and FIG. 7, a bar flange 20 extends radially from first bar end 16*a* on bar handle 12. A cap flange 42 also extends radially from retainer cap 34, thereby defining a hub recess 68 between cap flange 42 and bar flange 20. In alternative embodiments, hub recess 68 is defined directly between cap flange 42 and bar handle 12 when no bar flange 20 is present. Hub recess 68 provides a location for positioning hub 26 on weight plate 22. Cap flange 42 generally provides an axial stop to keep hub 26 from sliding axially off of retainer cap 34 when weight plate 22 is installed bar handle 12.

As seen in FIG. 7, recess cap 34 includes an axial cap bore 36 shaped for receiving a hub fastener 62. Hub fastener 62 may be inserted through cap bore 36 and engage a threaded bar hole 18 defined axially in bar handle 12. Recess cap 34 includes a cap clearance hole 44 shaped to correspond to the outer diameter of a threaded portion of hub fastener 62 in a clearance fit. When cap insert section 38 is fitted in bar socket 14, hub fastener 62 may pass through cap bore 36 and cap clearance hole 44 and threadedly engage threaded bar hole 18 to secure recess cap 34 to bar handle 12. In some embodiments, hub fastener 62 includes a socket head cap screw. In other embodiments, hub fastener 62 may include a manually removable bolt or quick-release fastener that can be quickly removed by a user to substitute interchangeable weight plates on bar handle 12.

In some applications, one or more bearings are positioned between weight plate 22 and bar handle 12 to provide a pivotable connection therebetween. Although certain embodiments of bearings are described herein, it is fully appreciated by those of skill in the art that other types of bearings, including ball bearings, may be substituted in various embodiments.

Figure 10:
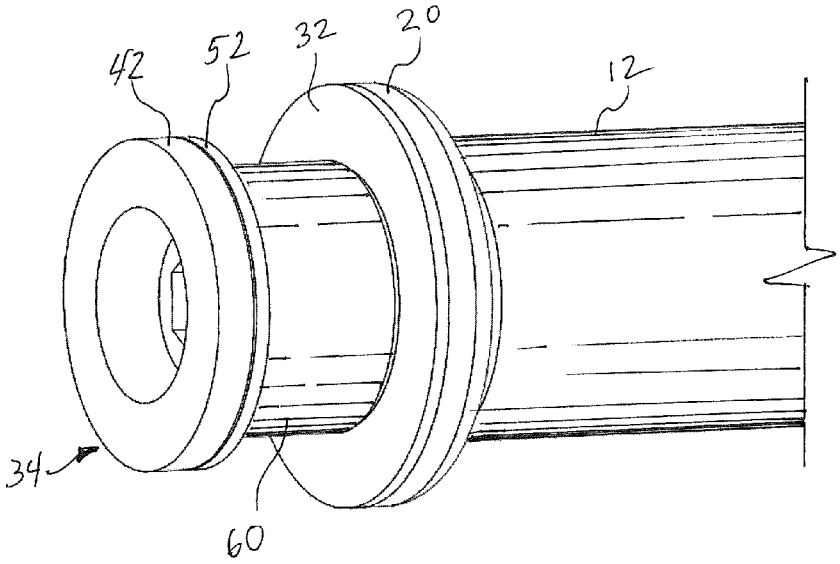
FIG. 10 illustrates a partial perspective view of an embodiment of a bar handle including a retainer cap and bearings in accordance with the present disclosure.
Figure 11:
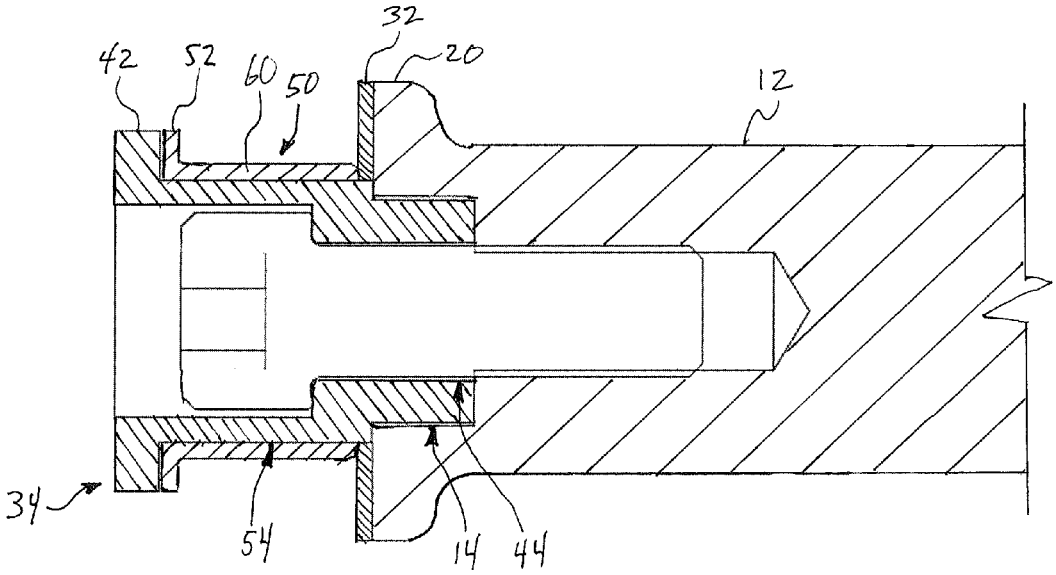
FIG. 11 illustrates a partial cross-sectional view of the embodiment of a bar handle including a retainer cap and bearings of FIG. 10.

The present disclosure provides a pivotable attachment having both a radial bearing and bi-directional axial thrust bearings for providing a freely pivotably joint regardless of the orientation of weight 10. As seen in FIG. 10 and FIG. 11, in some embodiments, one or more bearings are installed on retainer cap 34 for providing a pivotable connection between weight plate 22 and bar handle 12. A hub bearing 50 includes an annular sleeve shaped to fit in hub recess 68. Hub bearing 50 provides sliding contact with retainer cap 34, allowing weight plate 22 to freely rotate in both angular directions when a radial force component is applied, i.e. when weight apparatus 10 is lifted in a non-vertical orientation.

Hub bearing 50 in some embodiments includes a flange bearing having an axially-extending hub bearing body 60 defining a hub bearing bore 54 dimensioned to fit around cap hub section 40 in retainer cap 34. A hub bearing flange 52 extends radially from hub bearing 50 in some embodiments. Hub bearing flange 52 is shaped to engage cap flange 42 on retainer cap 34. Hub bearing flange 52 provides an axial bearing surface to allow free rotation between weight plate 22 and bar handle 12 when force is applied axially away from bar handle 12. Thus, when hub is installed in hub recess 68, as seen in FIG. 5, weight plate 22 may rotate freely about retainer cap 34. In some embodiments, hub bearing 50 includes a flange bearing such as the iglide type G300 flange bearings manufactured by igus Inc. of East Providence, R.I.

In additional embodiments, hub bearing 50 may include a non-flanged annular bearing, and hub bearing flange 52 may include a separate component such as an annular thrust washer positioned to rest against cap flange 42.

Also seen in FIG. 11, a bar thrust bearing 32 is positioned adjacent first bar end 16*a* on bar handle 12. Bar thrust bearing 32 provides free rotation between weight plate 22 and bar handle 12 when axial force is applied in the axial direction toward bar handle 12. Bar thrust bearing 32 generally operates opposite hub bearing flange 32 to allow pivotable motion in both axial directions. When axial force is directed away from bar handle 12, hub bearing flange 52 slidably engages cap flange 42 allows free rotation of weight plate 22. On the other hand, when axial force is directed toward bar handle 12, bar thrust bearing 32 engages the first bar end 16*a* and provides free rotation of weight plate 22. Bar thrust bearing 32 in some embodiments includes a polymer or plastic bearing such as the iglide model G300 Thrust Washer manufactured by igus, Inc. of East Providence, R.I. In other embodiments, various other model hub bearings 50, hub bearing flange 52 (or separate hub bearing washer) and bar thrust bearings 32 may be used to provide a freely pivotable connection between weight plate 22 and bar handle 12.

Figure 8:
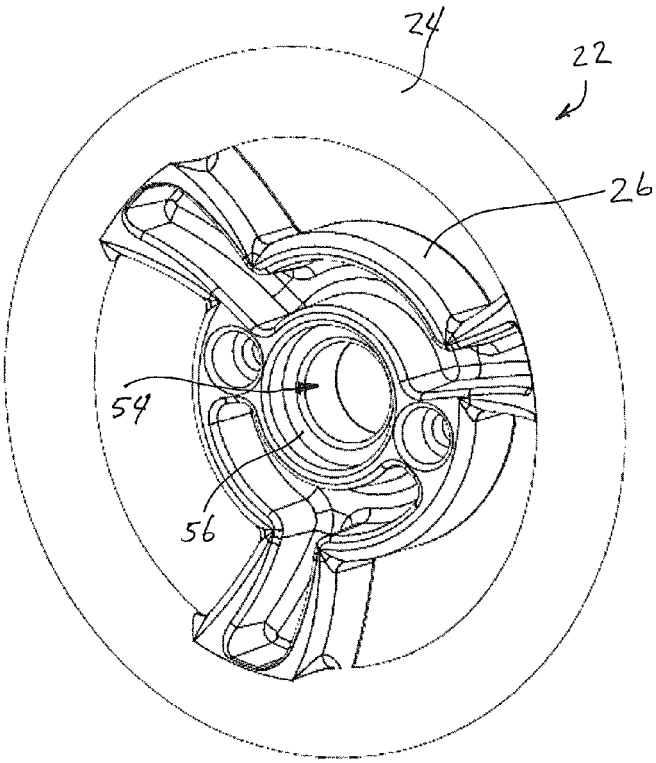
FIG. 8 illustrates a perspective view of an embodiment of a weight plate in accordance with the present disclosure.

As seen in FIG. 5 and FIG. 8 in some embodiments, weight plate 22 includes a hub bore 54 defining an axial passage through the center of hub 26. Hub bore 54 is generally shaped for receiving retainer cap 34 for securing weight plate 22 onto bar handle 12. Hub bore 54 includes a hub shoulder 56 extending radially inwardly. Hub shoulder 56 is shaped to engage hub bearing flange 52 on hub bearing 50 when hub 26 is installed on retainer cap 34, as seen in FIG. 5.

Figure 9:
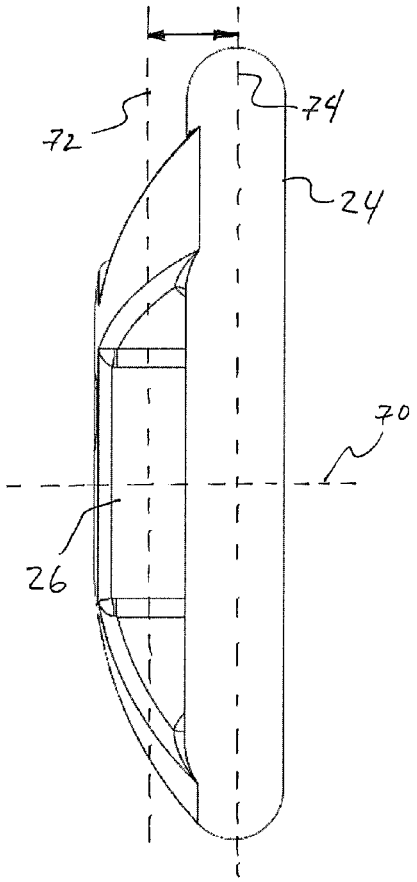
FIG. 9 illustrates a side elevation view of the embodiment of a weight plate of FIG. 8.

Referring now to FIG. 9, in some embodiments, a weight plate axis of rotation 70 is defined along the axial centerline of weight plate 22. Hub 26 includes a hub center plane 72, and grip ring 24 includes a grip ring center plane 74. In some embodiments, hub center plane 72 and grip ring center plane 74 are axially offset to provide grip regions on grip ring 24 that are slightly axially spaced from hub 26. This configuration may provide increased user comfort when performing lifting exercises that require grasping grip ring 24 in some applications.

Figure 12:
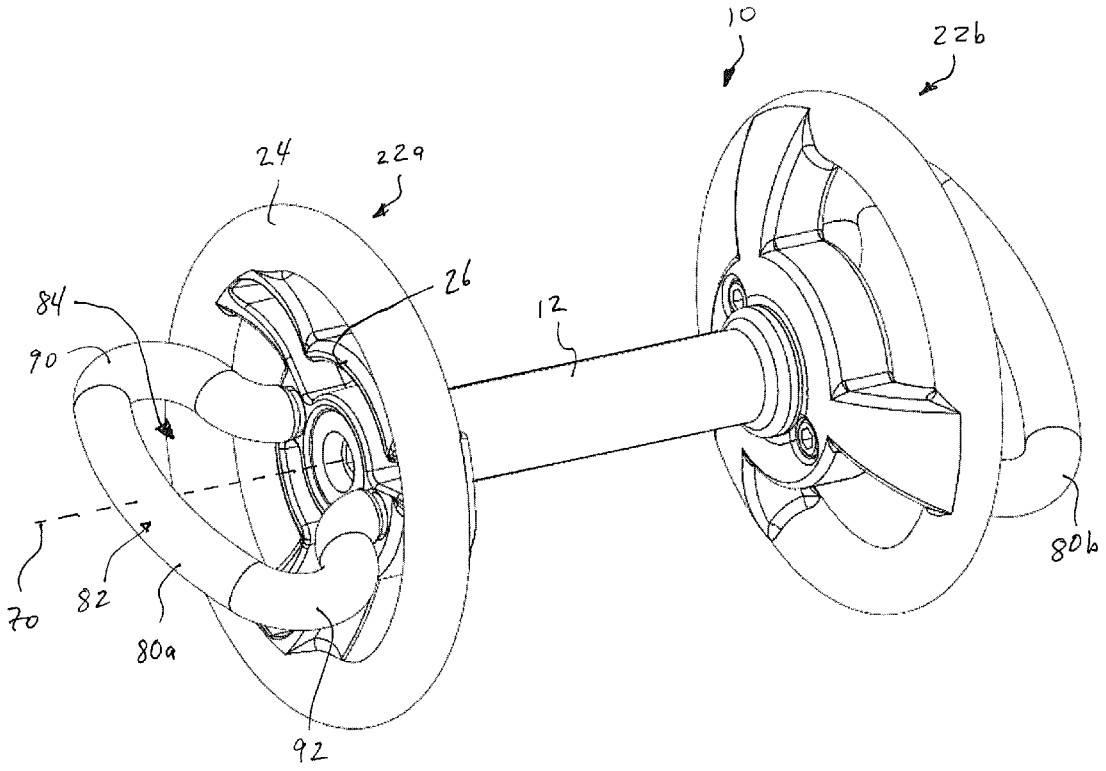
FIG. 12 illustrates a perspective view of an embodiment of a multi-grip exercise weight apparatus including first and second end handles in accordance with the present disclosure.
Figure 13:
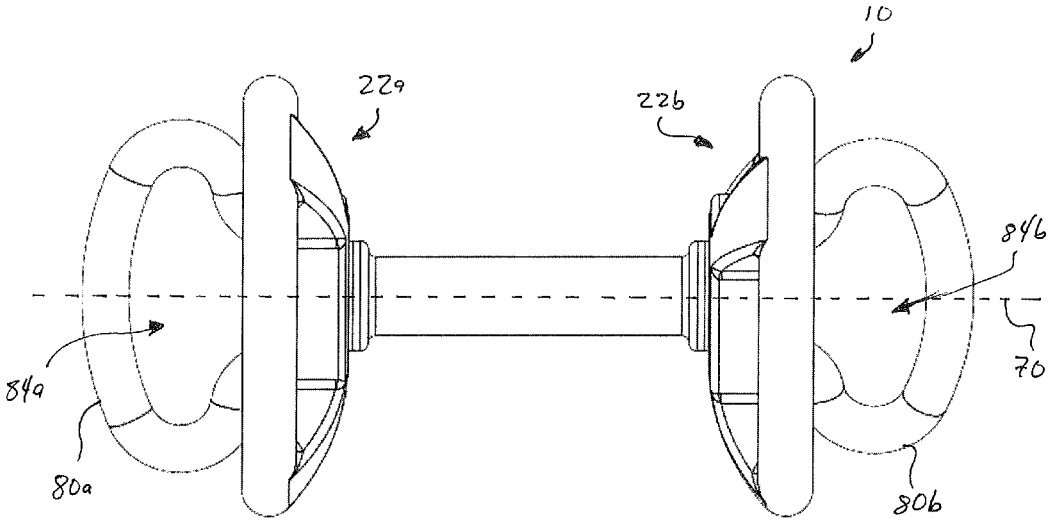
FIG. 13 illustrates a perspective view of an embodiment of an end handle for attachment to a weight plate in accordance with the present disclosure.

Referring now to FIG. 12, in some embodiments, a multi-grip exercise weight apparatus 10 can be further modified to include a first end handle 80*a* attached to first weight plate 22*a*. First end handle 80*a* in some embodiments includes a bent bar having a round cross-sectional profile to facilitate gripping by a user. First end handle 80*a* generally extends axially away from bar handle 12 from a weight plate. In some embodiments, only one end handle 80 is disposed on weight apparatus 10. In other embodiments, two end handles 80*a*, 80*b* may be disposed on weight apparatus 10—a first end handle 80*a* attached to first weight plate 22*a*, and a second end handle 80*b* attached to second weight plate 22*b*.

Figure 14:
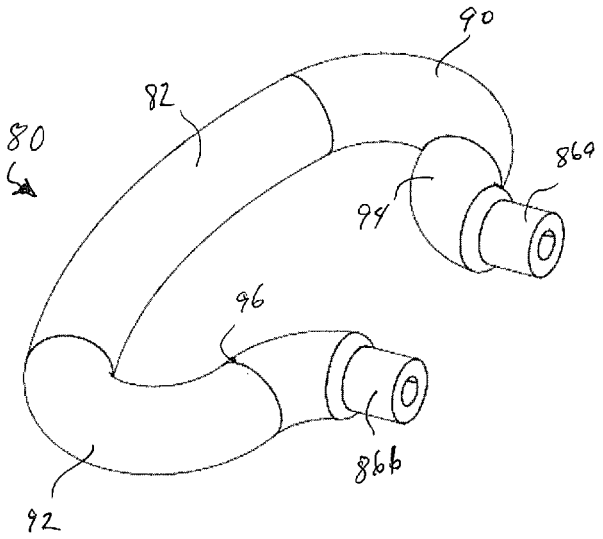
FIG. 14 illustrates an embodiment of an end handle for attachment to a weight plate in accordance with the present disclosure.

First end handle 80*a* includes an end handle grip 82 oriented substantially transverse to the weight plate axis of rotation 70. First end handle 80*a* also includes opposing first and second looped ends 90, 92 forming arcuate bends to further facilitate gripping by a user. In additional embodiments, as seen in FIG. 14, each end handle 80 includes first and second lateral supports 94, 96 extending inwardly from first and second looped ends 90, 92. A first axial boss 86*a* extends from first lateral support 94 in a direction substantially parallel to the weight plate axis of rotation 70 in some embodiments. A second axial boss 86*b* also extends from second lateral support 96 substantially parallel to first axial boss 86*a* in some embodiments. Each axial boss 86*a*, 86*b* is shaped to engage a corresponding end handle mounting hole 88*a*, 88*b* on hub 26, as seen in FIG. 3, in some embodiments. A fastener such as a threaded bolt may be inserted through each end handle mounting hole 88 on hub 26 to secure end handle to weight plate 22. As such, each end handle 80 is detachable relative to weight plate 22 such that a user may remove one or both end handles 80*a*, 80*b* from weight apparatus 10. In other embodiments, end handle 80 may be integrally formed on weight plate 22.

End handle 80 allows a user to grip weight apparatus 10 in a kettlebell grip in some applications. Conventional kettlebell weights include a weighted mass and a looped handle extending upwardly therefrom. In a similar fashion, the present disclosure provides a weight apparatus 10 with a looped end handle 80. A user may grasp the looped end handle 80, or kettlebell grip 80, with weight 10 in a vertical or upright orientation for performing exercises that would typically be done using a conventional kettlebell. Thus, the weight apparatus 10 allows one piece of equipment to be used for different lifting exercises requiring normal or kettlebell type grips where previously multiple pieces of equipment were necessary.

Figure 15:
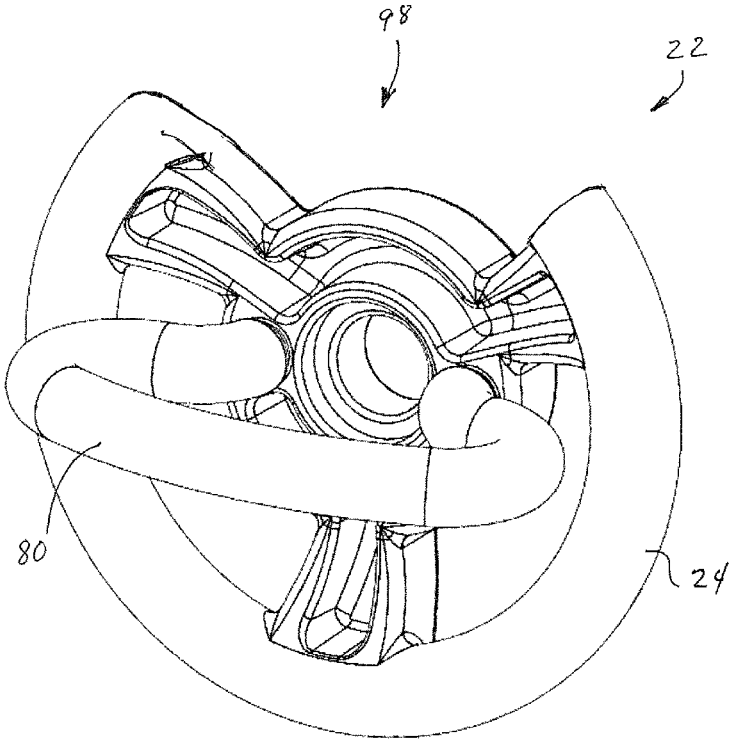
FIG. 15 illustrates an alternative embodiment of a weight plate including an end handle attached thereto in accordance with the present disclosure.

Referring now to FIG. 15, an alternative embodiment of a weight plate 22 including an end handle 80 is illustrated. A grip recess 98 is defined in grip ring 24. Grip recess 98 provides a space where a user's forearm may pass without interfering with grip ring 24 during a lifting exercise using end handle 80 in a kettlebell grip. Grip recess 98 may be provided as a space between adjacent support spokes. Alternatively, grip recess may be provided as an indentation or inward curve in grip ring 24.

Thus, although there have been described particular embodiments of the present invention of a new and useful Multi-Grip Exercise Weight Apparatus, it is not intended that such references be construed as limitations upon the scope of this invention except as set forth in the following claims.

What is claimed is:

1. A multi-grip exercise weight apparatus, comprising:

a bar handle having a bar handle axis, a first bar end, and a second bar end;

a first weight plate attached to the first bar end, the first weight plate including a weight plate axis substantially co-linear with the bar handle axis and a hub pivotally attached to the bar handle about the bar handle axis, the hub having a first radius and a hub center plane extending perpendicularly through the weight plate axis;

a first grip ring disposed on the first weight plate, the first grip ring having a second radius larger than the first radius, the first grip including a first grip ring center plane extending perpendicularly through the weight plate axis with the first grip ring center plane axially spaced from the hub center plane of the first weight plate;

a first support spoke extending between the hub and the first grip ring;

a second support spoke extending between the hub and the first grip ring;

a first arcuate grip region defined on the first grip ring, the first arcuate grip region extending between the first and second support spokes;

a first hand clearance opening defined radially between the first arcuate grip region and the hub and angularly between the first and second support spokes; and a first end handle attached to the first weight plate, the first end handle including an end handle grip region oriented substantially transverse to the weight plate axis and intersecting the bar handle axis.

2. The apparatus of claim 1, further comprising:

a second arcuate grip region defined on the first grip ring adjacent the first arcuate grip region; and a second hand clearance opening defined radially between the second arcuate grip region and the hub.

3. The apparatus of claim 1, wherein the hub, the grip ring, the first support spoke, and the second support spoke are integrally formed in a one-piece construction.

4. The apparatus of claim 1, wherein:

the first weight plate is freely pivotable relative to the bar handle in both angular directions.

5. The apparatus of claim 1, wherein the grip ring is concentrically disposed about the hub.

6. The apparatus of claim 1, wherein the grip ring is axially offset from the hub.

7. The apparatus of claim 1, wherein the first end handle is attached to the hub.

8. The apparatus of claim 1, wherein the first end handle includes a kettlebell grip.

9. The apparatus of claim 1, further comprising a second weight plate attached to the second bar end, the second weight plate being substantially identical to the first weight plate; and a second end handle attached to the second weight plate, the second end handle being substantially identical to the first end handle.

10. The apparatus of claim 9, wherein the second weight plate is freely pivotable relative to the bar handle in both angular directions.

11. A weight plate apparatus for attachment to a bar handle on an exercise weight, the weight plate apparatus comprising:

a hub shaped to pivotally attach to the bar handle about a bar handle axis, the hub having a hub center plane extending perpendicularly through the bar handle axis;

a plurality of support spokes extending radially from the hub;

a grip ring disposed on the support spokes, the grip ring including a plurality of grip regions, each grip region located on the grip ring between adjacent support spokes, the grip ring including a grip ring center plane extending perpendicularly through the bar handle axis with the grip ring center plane axially spaced from the hub center plane;

a plurality of hand clearance openings, each one of the plurality of hand clearance openings defined angularly between adjacent ones of the plurality of support spokes, and each hand clearance opening located radially between the hub and the grip ring; and an end handle attached to the hub, the end handle extending axially away from the weight plate in an axial direction opposite the bar handle when the hub is pivotally attached to the bar handle.

12. The apparatus of claim 11, wherein the hub, the grip ring, and the plurality of support spokes are integrally formed in a one-piece construction.

13. The apparatus of claim 11, wherein the end handle is removable from the weight plate.

14. A multi-grip exercise weight apparatus, comprising:

a bar handle having a longitudinal axis, a first bar end and a second bar end;

a first weight plate attached to the first bar end, the first weight plate defining a weight plate axis of rotation oriented substantially parallel to the longitudinal axis of the bar handle, the first weight plate having a first weight plate center plane extending perpendicularly through the weight plate axis of rotation;

a first grip ring operatively attached to and concentrically disposed about the first weight plate, the first grip ring defining a plurality of grip regions between the first weight plate and the first grip ring, the first grip ring including a first grip ring center plane extending perpendicularly through the weight plate axis of rotation with the first grip ring center plane axially spaced from the first weight plate center plane along the weight plate axis of rotation;

a first end handle operatively attached to the first weight plate in an axial direction away from the bar handle, the first end handle including an end handle grip oriented substantially transverse to the weight plate axis of rotation;

a second weight plate attached to the second bar end, the second weight plate substantially aligned along the weight plate axis of rotation, the second weight plate having a second weight plate center plane extending perpendicularly through the weight plate axis of rotation;

a second grip ring operatively attached to and concentrically disposed about the second weight plate, the second grip ring defining a plurality of grip regions between the second weight plate and the second grip ring, the second grip ring including a second grip ringer center plane extending perpendicularly through the weight plate axis of rotation with the second grip ring center plane axially spaced from the second weight plate center plane along the weight plate axis of rotation;

a second end handle extending from the first weight plate in an axial direction away from the bar handle, the second end handle including an end handle grip oriented substantially transverse to the weight plate axis of rotation.

15. The apparatus of claim 14, wherein each end handle is removable from the associated weight plate.

16. The apparatus of claim 14, wherein each weight plate is freely pivotally attached to the bar handle in both angular directions.

17. The apparatus of claim 14, wherein at least one weight plate is fixed.

18. The apparatus of claim 14, wherein each weight plate is freely pivotally attached to the bar handle in only one angular direction.

19. The apparatus of claim 14, wherein the first end handle is operatively attached to the first weight plate in at least one location offset from the weight plate axis of rotation.

20. The apparatus of claim 14, wherein the first grip ring and the first weight plate are integrally formed in a one-piece construction.

* * * * *